US006843173B2

(12) United States Patent
Shih

(10) Patent No.: US 6,843,173 B2
(45) Date of Patent: Jan. 18, 2005

(54) COVER FOR A NUMBERING STAMP

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/464,577

(22) Filed: Jun. 19, 2003

(65) Prior Publication Data

US 2004/0255801 A1 Dec. 23, 2004

(51) Int. Cl.[7] ..... B41J 1/60
(52) U.S. Cl. ..... 101/111; 101/405; 101/327
(58) Field of Search ..... 101/405, 406, 101/111, 333, 327, 368, 379; D18/14

(56) References Cited

U.S. PATENT DOCUMENTS 1,093,485 A * 4/1914 Sootford et al. ..... 101/111
2,088,009 A * 7/1937 Melind ..... 101/111
2,096,340 A * 10/1937 Richeson ..... 101/111
3,363,548 A * 1/1968 Aijima ..... 101/83
3,955,449 A * 5/1976 Hofmeister et al. ..... 81/484
3,955,499 A * 5/1976 Funahashi ..... 101/111
4,561,353 A * 12/1985 Chapman et al. ..... 101/111
D371,386 S * 7/1996 Smith ..... D18/15
5,819,650 A * 10/1998 Shih ..... 101/111
6,302,022 B1 * 10/2001 Shih ..... 101/379
6,453,813 B1 * 9/2002 Faber ..... 101/405
D478,930 S * 8/2003 Zambelli et al. ..... D18/15

* cited by examiner

*Primary Examiner*—Eugene H. Eickholt
(74) *Attorney, Agent, or Firm*—Fei-Fei Chao; Bingham McCutchen LLP

(57) ABSTRACT

A cover for a numbering stamp has a cover body, two side surfaces, an outer surface, two recesses and multiple slots. The cover body is U-shaped, and each recess is defined on one of the side surfaces. The recesses attach to the stamping apparatus. The slots are defined through the outer surface of the cover, and multiple adjustment disks of the stamping apparatus extend respectively out of the slots. The cover for the numbering stamp prevents a person's fingers from getting dirty.

2 Claims, 5 Drawing Sheets

COVER FOR A NUMBERING STAMP

BACKGROUND OF THE INVENTION

1. Field of the Invention

The present invention relates to a cover for a numbering stamp, and more particularly to a cover that can keep a person from getting ink on his or her fingers.

2. Description of Related Art

A numbering stamp is used for stamping a date or a series of numbers on papers. The numbering stamp has a body and a stamping apparatus. The body has a distal end, a proximal end and an inner concavity, and the stamping apparatus is mounted inside the distal end of the body. The stamping apparatus has multiple stamping devices and multiple adjustment disks. The stamping devices are aligned with each other and are mounted in the stamping apparatus. The adjustment disks correspond respectively to the stamping devices, are mounted adjacent to the corresponding stamping device and are used to select a number for the corresponding stamping device. When a person sets the date or numbers on the numbering stamp, the person's fingers are easily stained by ink on the stamping devices.

The present invention provides a cover for a numbering stamp to mitigate or obviate the aforementioned problem.

SUMMARY OF THE INVENTION

An objective of the present invention is to provide a cover for a numbering stamp, which can be retained in place when setting numbers on the numbering stamp.

A cover adapted to a numbering stamp has a cover body, two side surfaces, an outer surface, two recesses and multiple slots. The cover body is U-shaped and each recess is defined on one of the side surfaces. The recesses hold the cover on the stamping apparatus. The slots are defined through the outer surface of the cover, and adjustment disks extend respectively out of the slots. The cover for the numbering stamp prevents the numbering stamp from getting a person's fingers dirty.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
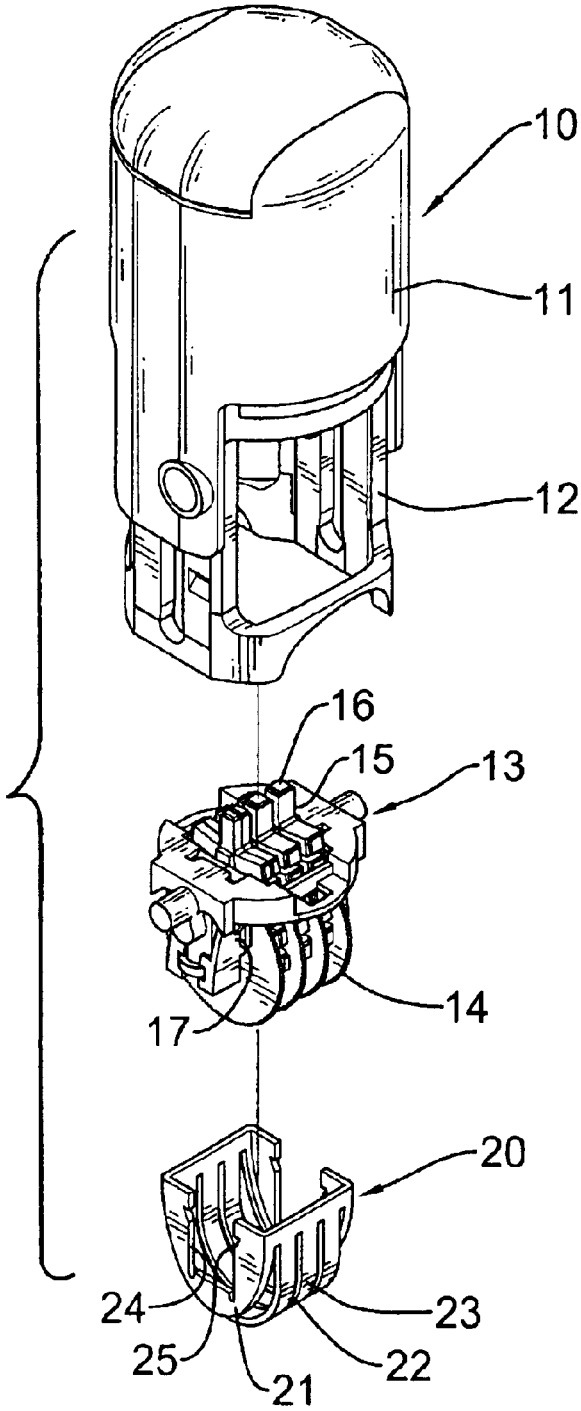
FIG. 1 is an exploded perspective view of a first embodiment of a cover for a numbering stamp in accordance with the present invention.

With reference to FIG. 1, a first embodiment of a cover (20) for a numbering stamp (10) in accordance with the present invention has a cover body (21), two side surfaces (not numbered), an inner cavity (not numbered) and two recesses (24).

The cover (20) is mounted on a conventional numbering stamp (10), such as a dater which has a hollow body (11), an inner cavity (not numbered), a stamp seat (12) and a stamping apparatus (13).

The hollow body (11) has a closed end (not numbered) and an open end (not numbered).

The stamp seat (12) has two square openings (not numbered). The stamping seat (12) is slidably mounted inside the hollow body (11) and extends from the open end of the hollow body (11).

The stamping apparatus (13) is pivotally mounted on the stamp seat (12) near the open end of the hollow body (11). In practice, a rotating device is mounted between the stamp seat (12) and the stamping apparatus (13) to pivotally rotate the stamping apparatus (13) relative to the stamp seat (12) when the stamp seat (12) is pushed into the hollow body (11). The stamping apparatus (13) has a top surface (not numbered), a bottom surface (not numbered), two side surfaces (not numbered), a holder (not numbered), two pivot pins (not numbered), at least one adjustment disk (14), at least one stamping device (15) and at least two mounting brackets (17). The holder has a central opening (not numbered) and two side protrusions (not numbered). Each pivot pin is formed on the side protrusion. Multiple stamping devices (15) are rotatably mounted in the stamping apparatus (13) and partially extended out of the central opening of the holder. Each adjustment disk (14) is mounted with and controls a corresponding stamping device (15). Each stamping device (15) has multiple stamping faces (16) to selectively stamp a number. The mounting brackets (17) are formed respectively below the side protrusions of the holder of the stamping apparatus (13) near the pivot pins that are pivotally mounted in stamp seat (12). The stamping apparatus (13) can rotate around the pivot pins. Rotating the adjustment disk (14) rotates the stamping device (15) so the stamping face (16) is a selected number visible through the square opening in the stamp seat (12). When pushing the stamping seat (12) inside the hollow body (11), the rotating device will drive the stamping apparatus (13) to rotate 180° relative to the stamp seat (12). After the stamping apparatus (13) rotates around the pivot pins at 180°, the stamping face (16) will extend out the stamping seat (12) to stamp on papers. Because the numbering stamp (10) is conventional, operation of the numbering stamp (10) is not further described.

The cover (20) is mounted outside the bottom surface of the stamping apparatus (13) of the numbering stamp (10). From a side perspective, the cover (20) is U-shaped, and the cover body (21) has an outer surface (not numbered), multiple slots (22) and multiple guards (23). The slots (22) are defined through the outer surface are U-shaped and correspond respectively to the adjustment disks (14). The guards (23) are formed respectively between adjacent slots (22). A recess (24) is defined in each side surface of the cover body (21) and has at least two edges (not numbered). A notch (25) is defined on at least one of the edges of the recess (24).

Figure 2:
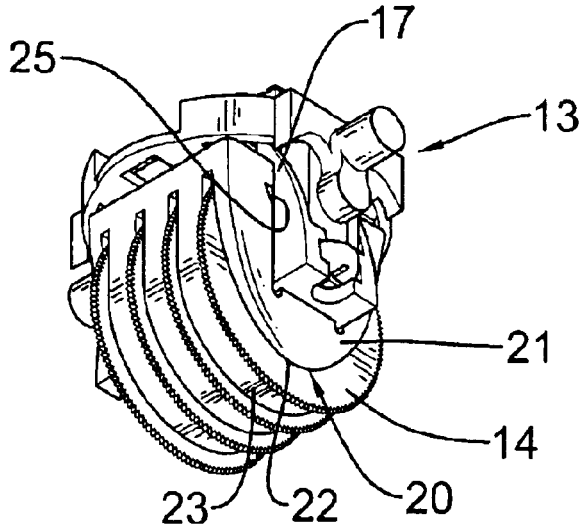
FIG. 2 is a perspective view of a stamping apparatus in a numbering stamp in FIG. 1.

With further reference to FIG. 2, the stamping apparatus (13) is mounted in the inner cavity in the cover (20), and the adjustment disks (14) extend respectively out of the slots (22). The stamping devices (15) are mounted inside the guards (23), and each stamping device (15) corresponds to one of the guards (23). The recesses (24) in the cover body (21) are mounted respectively on mounting brackets (17) formed below the side protrusions of the holder of the stamping apparatus (13). The mounting brackets (17) have multiple protruding clips (not numbered) corresponding to and engaged by the notches (25) of the cover (20).

Figure 4:
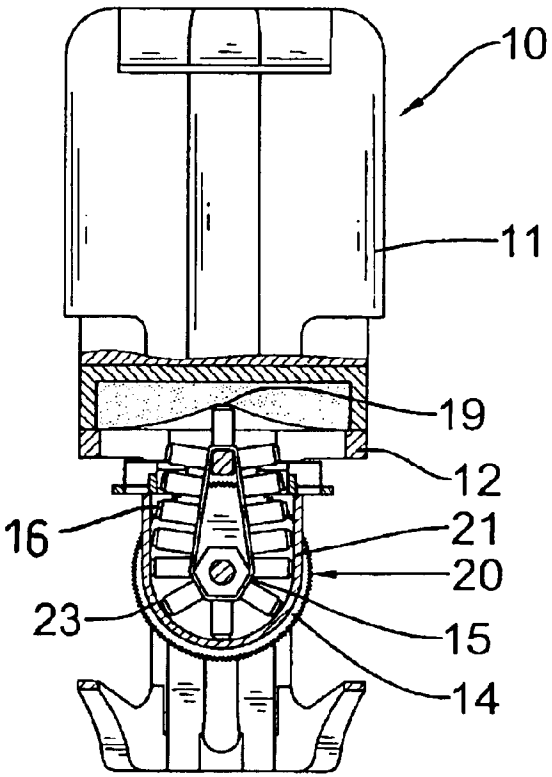
FIG. 4 is a side plan view in partial section of the cover in FIG. 1 on a numbering stamp.
Figure 3:
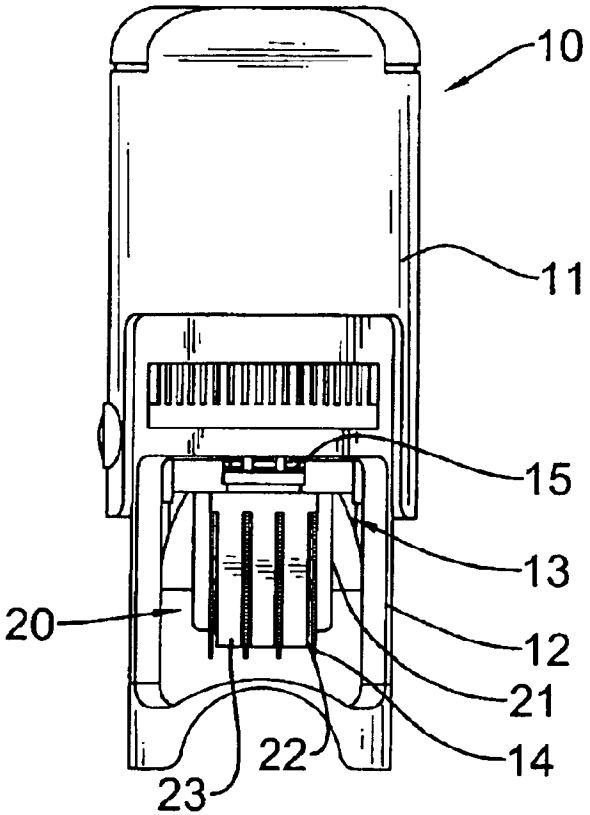
FIG. 3 is a front plan view of the cover in FIG. 1 on a numbering stamp.

With reference to FIGS. 3 and 4, desired numbers are selected on the stamping devices (15) by rotating the adjustment disks (14) that extend out of the slots (22) in the cover body (21). Then the stamp seat (12) is pushed into the inner cavity in the hollow body (11) and the stamping apparatus (13) is rotated by the rotating device to rotate 180° to expose the stamping faces (16) out from the stamp seat (12). When the adjustment disks (14) are rotated, the stamping devices (I5) are held inside the guards (23) that prevent a person's fingers from getting dirty.

Figure 5:
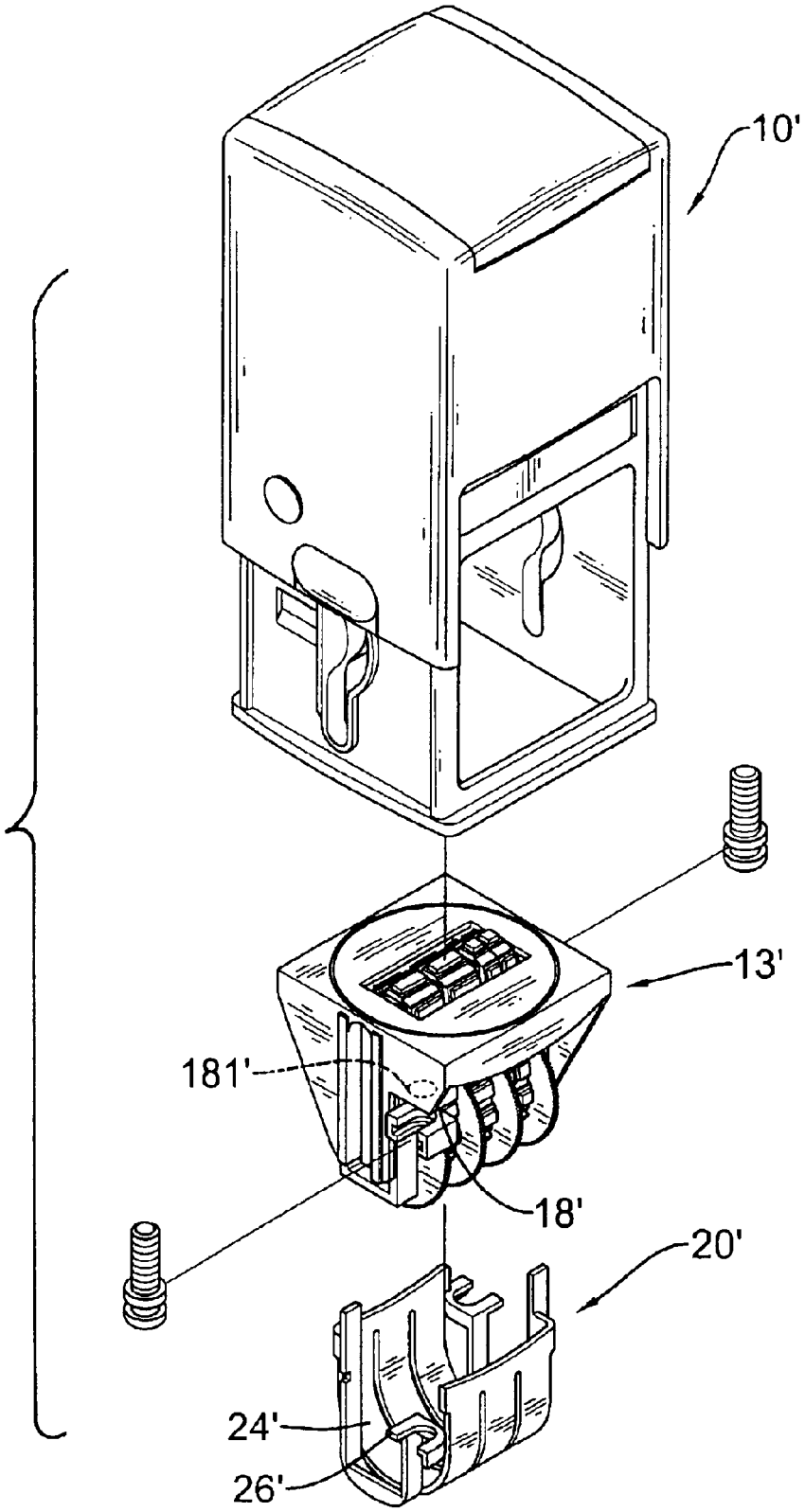
FIG. 5 is an exploded perspective view of a second embodiment of a cover for a numbering stamp in accordance with the present invention.

With reference to FIG. 5, a second embodiment of the cover (20') for a second conventional numbering stamp (10') further comprises an extending protrusion (18') and a transverse holder (not numbered) formed on the respective side surface of the holder. Each extending protrusion (18') has a hole (181') defined inside the holding protrusion (18'). The second embodiment of the cover (20') further comprises a transverse U-shaped holder (26') mounted on the respective recesses (24').

Figure 6:
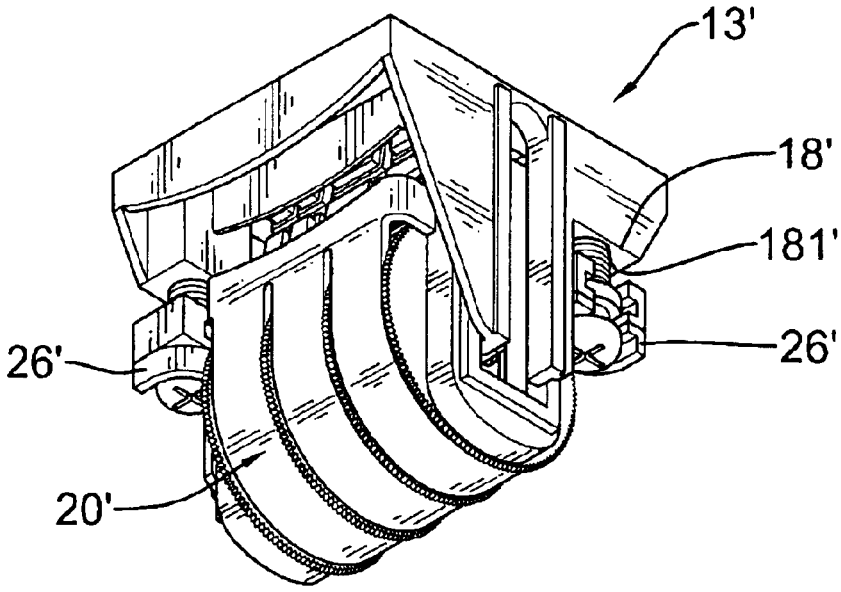
FIG. 6 is a perspective view of the stamping apparatus in a numbering stamp in FIG. 5.
Figure 8:
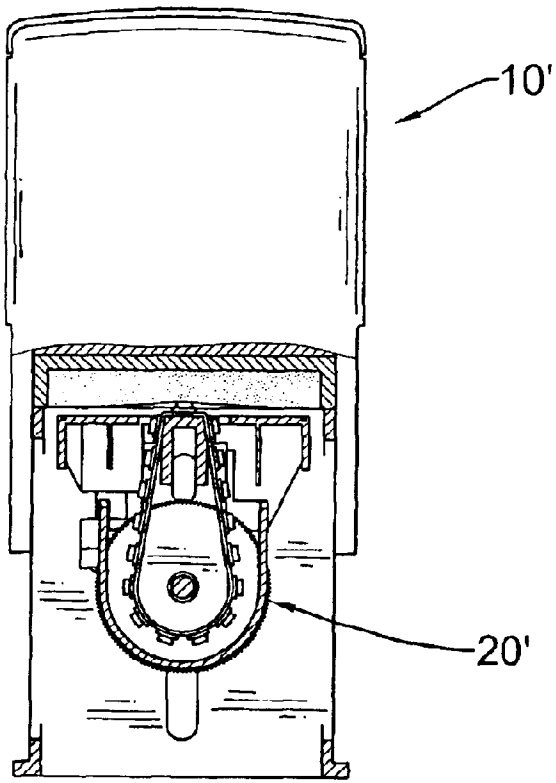
FIG. 8 is a side plan view of the cover in FIG. 5 on a numbering stamp.
Figure 7:
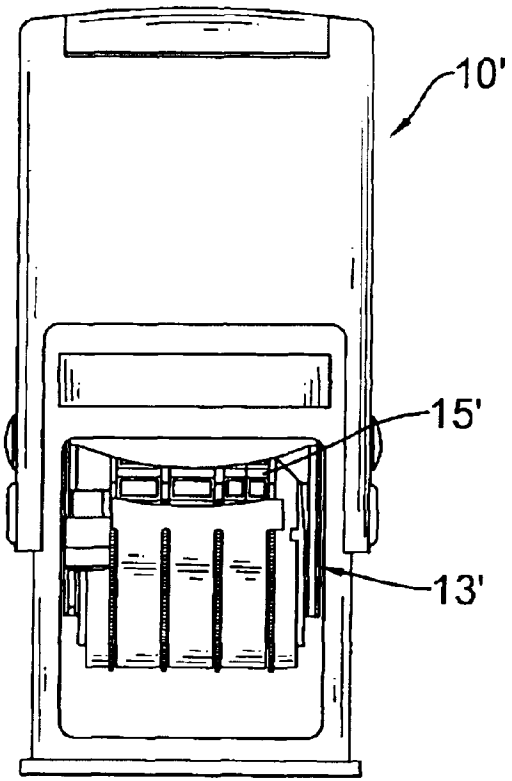
FIG. 7 is a front plan view of the cover in FIG. 5 on a numbering stamp.

With reference to FIG. 6, the cover (20') is mounted on the stamping apparatus (13') by screwing a screw through the transverse U-shaped holder (26') of the cover (20') into the hole (181') in the extending protrusion (18') of the stamping apparatus (13'). With reference to FIGS. 7 and 8, numbers on the stamping devices (15') in the stamping apparatus (13') are selected in the same manner as the previously described embodiment, and the cover (20') mounted on the stamping apparatus (13') prevents a person's fingers from getting dirty.

Even though numerous characteristics and advantages of the present invention have been set forth in the foregoing description, together with details of the structure and function of the invention, that the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. A cover for a numbering stamp that has a stamping apparatus and multiple adjustment disks mounted in the stamping apparatus, wherein the cover has a cover body being U-shaped, an inner cavity defined in the cover body to hold the stamping apparatus of the numbering stamp, an outer surface, two side surfaces, multiple slots defined through the outer surface of the cover for the adjustment disks extending respectively out of the slots, and two recesses respectively defined in the two side surfaces for attaching to the stamping apparatus, and each recess having at least two edges and two notches to hold the cover on the stamping apparatus, wherein each notch is defined on one edge of the recess.

2. The cover as claimed in claim 1, wherein each recess further comprises a transverse U-shaped holder adapted to hold the stamping apparatus and a screw screwing through the transverse U-shaped holder and adapted to screw into the stamping apparatus for holding the stamping apparatus.

* * * * *